US008757683B2

(12) United States Patent
Schiffer

(10) Patent No.: US 8,757,683 B2
(45) Date of Patent: Jun. 24, 2014

(54) APPARATUS FOR A MOTOR VEHICLE LOCK

(75) Inventor: Holger Schiffer, Essen (DE)

(73) Assignee: Kiekert AG, Heiligenhaus (DE)

( * ) Notice: Subject to any disclaimer, the term of this patent is extended or adjusted under 35 U.S.C. 154(b) by 252 days.

(21) Appl. No.: 13/123,238

(22) PCT Filed: Dec. 3, 2009

(86) PCT No.: PCT/DE2009/001725

§ 371 (c)(1),
(2), (4) Date: Apr. 8, 2011

(87) PCT Pub. No.: WO2010/075832

PCT Pub. Date: Jul. 8, 2010

(65) Prior Publication Data

US 2011/0193353 A1 Aug. 11, 2011

(30) Foreign Application Priority Data

Dec. 17, 2008 (DE) ..... 10 2008 063 489

(51) Int. Cl.
*E05C 3/06* (2006.01)
*E05C 3/00* (2006.01)

(52) U.S. Cl.
USPC ..... 292/216; 292/201; 292/DIG. 23; 292/DIG. 56; 292/DIG. 73

(58) Field of Classification Search
USPC ..... 292/DIG. 38, 201, 216, DIG. 16, 292/DIG. 23, DIG. 54, DIG. 56, DIG. 57, 292/DIG. 58, DIG. 73, 194, 198, 292/341.15–341.17
See application file for complete search history.

(56) References Cited

U.S. PATENT DOCUMENTS

| | | | | | |
|---|---|---|---|---|---|
| 1,194,636 | A | * | 8/1916 | Joy | 292/163 |
| 2,125,779 | A | * | 8/1938 | Geyer | 292/2 |
| 4,073,519 | A | * | 2/1978 | Kurozu et al. | 292/216 |
| 4,538,845 | A | * | 9/1985 | Yamada | 292/216 |
| 4,756,564 | A | * | 7/1988 | Ikeda | 292/216 |
| 4,783,103 | A | * | 11/1988 | Schlegel | 292/216 |
| 4,854,617 | A | * | 8/1989 | Hayakawa et al. | 292/216 |
| 4,856,829 | A | * | 8/1989 | Nakamura et al. | 292/216 |
| 4,875,723 | A | * | 10/1989 | Compeau et al. | 292/201 |
| 4,971,373 | A | * | 11/1990 | Hamada et al. | 292/216 |
| 5,273,324 | A | * | 12/1993 | Kobayashi | 292/201 |
| 5,277,461 | A | * | 1/1994 | Dzurko et al. | 292/216 |
| 5,511,839 | A | * | 4/1996 | Fuss et al. | 292/341.18 |

(Continued)

FOREIGN PATENT DOCUMENTS

| | | | |
|---|---|---|---|
| DE | 2320351 | A * | 10/1974 |
| DE | 102004007149 | A1 * | 8/2005 |

(Continued)

*Primary Examiner* — Carlos Lugo
*Assistant Examiner* — Alyson M Merlino
(74) *Attorney, Agent, or Firm* — Renner, Otto, Boisselle & Sklar, LLP

(57) ABSTRACT

An apparatus (1) for a motor vehicle lock (2), includes at least a catch (3) with an axis of rotation (14), a work arm (4), an impact arm (15), and a catch bolt recess (16) arranged between the work arm and the impact arm, wherein the work arm comprises a first metallic member (9) and forms a first position (5) and a primary position (6). The apparatus further includes at least a latch case (19) and a pawl (7) with a cantilever arm (17), an axis of rotation (18), and a locking position (8).

20 Claims, 1 Drawing Sheet

(56) References Cited

U.S. PATENT DOCUMENTS

| | | | | |
|---|---|---|---|---|
| 5,544,925 | A * | 8/1996 | Ikeda | 292/216 |
| 5,632,515 | A * | 5/1997 | Dowling | 292/216 |
| 5,632,517 | A | 5/1997 | Paulik et al. | |
| 5,642,636 | A * | 7/1997 | Mitsui | 70/237 |
| 6,209,932 | B1 * | 4/2001 | Jung et al. | 292/216 |
| 6,749,234 | B2 * | 6/2004 | Bruce | 292/216 |
| 6,820,912 | B1 * | 11/2004 | Lavoie | 296/65.03 |
| 7,475,923 | B2 * | 1/2009 | Ottino et al. | 292/216 |
| 7,726,707 | B2 * | 6/2010 | Simchayoff et al. | 292/216 |
| 2006/0279090 | A1 * | 12/2006 | Ottino et al. | 292/216 |

FOREIGN PATENT DOCUMENTS

| | | | |
|---|---|---|---|
| DE | 20 2006 018 500 | U1 | 5/2008 |
| DE | 102007041478 | A1 * | 3/2009 |
| FR | 2 877 973 | A1 | 5/2006 |

* cited by examiner

APPARATUS FOR A MOTOR VEHICLE LOCK

CROSS-REFERENCE TO RELATED APPLICATIONS

This is a National Stage Application of International Patent Application No. PCT/DE 2009/001725, with an international filing date of Dec. 3, 2009, which is based on German Patent Application No. 10 2008 063 489.1, filed Dec. 17, 2008.

BACKGROUND OF THE INVENTION

1. Field of the Invention

The invention relates to an apparatus for a motor vehicle lock, comprising at least one catch, made of a non-metallic material, with at least one work arm, wherein the at least one work arm is at least partially made of a metallic material. Such a motor vehicle lock is usually applied in a motor vehicle for securing doors, hatches, tail gates, etc.

2. Brief Description of the Related Art

DE 20 2006 018 500 U1 describes a motor vehicle door lock with a locking mechanism consisting of, in essence, a catch and a pawl, with the locking mechanism being made mainly of plastic as the core material. This locking mechanism is reinforced at particularly stressed areas of the catch or the pawl by high-strength plastic, or the catch and the pawl are made entirely of high-strength plastic. In addition, this document discloses the arrangement of inserts, made from this high-strength plastic, in highly stressed areas. The conventional locking mechanism comprises a catch with two work arms, wherein one work arm includes a first position and a primary position. Because relatively large areas of the catch are exposed to high loads, many areas of the catch must be strengthened.

The task of the invention is, therefore, to solve the above-described problems, at least partially, and to provide an apparatus for a motor vehicle lock comprising a locking mechanism (catch and/or pawl), which has a comparably low weight, yet, at the same time, a very high strength. In addition, where applicable, the operating comfort is to be improved and/or the operating noise is to be lowered while maintaining high safety (e.g., in the event of a crash).

BRIEF DESCRIPTION OF THE INVENTION

These tasks are achieved with a locking device having the features as in claim 1. Advantageous embodiments of the locking device are given in the dependent claims. It should be noted that the single limitations included in the dependent claims can be combined with one another in any technologically sensible way to define further embodiments of the invention. In addition, the features specified in the claims are clarified and explained in the description, wherein additional preferred embodiments of the invention are shown.

An apparatus for a motor vehicle lock, according to the invention, comprises at least a catch with a work arm, an axis of rotation, an impact arm, and a catch bolt recess disposed between the work arm and the impact arm, wherein the work arm comprises a first metallic member and forms a first position and a primary position. The apparatus further comprises at least a latch case and a pawl having a cantilever arm, an axis of rotation, and a locking position.

The term "work arm" refers to and is understood by a skilled artisan to mean that region of a catch which is impacted in the primary position or the first position by a force originating from the catch bolt. The locking mechanism, according to the invention, comprises a catch with a work arm, wherein the work arm comprises a first position and a primary position. The catch consequently has a work arm. This work arm is (partially) made of a metallic material, and is encapsulated with plastic. The term "primary orientation" of the locking mechanism refers to such operating condition or orientation of the catch, in which the catch is fully closed and the opening movement of the catch is blocked by the pawl. The term "primary position" of the catch also refers to the area of the catch which is contacted when the locking mechanism assumes the primary orientation. The term "first orientation" of the locking mechanism refers to such operating condition or orientation of the catch in which the catch is not yet fully closed, but in which the opening movement of the catch is already being blocked by the pawl. The term "first position" of the catch also refers to the area of the catch which is contacted when the locking mechanism assumes the first orientation.

The first metallic member of the work arm of the catch may be, for example, cast into the catch and/or adhesively attached on the work arm of the catch, or attached by other means. Preferred is an arrangement of the first metallic member in the area of the work arm that is particularly highly stressed. The first metallic member (e.g., a plate-like component formed by stamping) has a thickness particularly between 4 mm and 6 mm, preferably 5 mm, and comprises particularly a high-strength alloy steel or hardened steel, and has as small as possible surface roughness. In addition, the catch may have grooves or guide members for the first metallic member, for example, to ensure precise positioning of the first metallic member on/in the catch or on/in the work arm of the catch. The work arm may be comprised entirely of the first metallic member, wherein in this case, the first metallic member is connected to the catch near the axis of rotation of the catch or at another position of the catch. In addition, the first metallic member should form or enclose the axis of rotation of the catch. Furthermore, the first position or the primary position arranged on the work arm preferably at least partially comprises the first metallic member. The impact arm is that area of the catch which lies approximately opposite the work arm with respect to the catch bolt recess, and via which no force is transferred in the main orientation or in the primary orientation of the catch. Preferred is a catch, wherein the work arm with the first position and/or the primary position and the bearing that forms the axis of rotation of the catch are made of a single metallic member.

In addition, the pawl has a cantilever arm comprising a locking position. In other words, the cantilever arm forms an area (e.g., disposed opposite of the axis of rotation of the pawl), which cooperates with the catch in the primary position or in the first position, and which also blocks the opening movement of the catch.

According to an advantageous embodiment of the invention, the cantilever arm of the pawl is formed from a non-metallic material. It is envisaged that the cantilever arm of the pawl is formed from a non-metallic material (in particular, together with a bearing that forms the pawl). In addition, however, the locking position of the pawl is, in particular, also locally reinforced, especially with metal.

It is particularly advantageous if the impact arm of the catch is made of a non-metallic material. The impact arm is that part of the catch onto which the catch bolt acts during the closing movement. The impact arm lies opposite the work arm with respect to the catch bolt recess. Because the impact arm is made of a non-metallic material, e.g., preferably from plastic, the weight of the catch can be reduced significantly. Nevertheless, the stability of the catch is not substantially reduced by the work arm, which is made, at least partially, from a metallic material (first metallic member).

According to another preferred embodiment of the invention, the locking position of the pawl comprises a second metallic member. It is preferred that the second metallic member is cast into the pawl at or near the locking position of the pawl and/or is attached by adhesion by other means to the pawl. Furthermore, it is considered a part of the invention that the pawl has at least one recess or at least a guide element for attaching the second metallic member to the pawl at an exact position. Here, it should be noted also that the second metallic member is not necessarily limited to the vicinity of the locking position of the pawl, but may extend over the pawl, at least partially. Depending on the design of the pawl, the second metallic member should extend at least over those regions of the pawl which are particularly highly stressed during the various phases of operation of the motor vehicle lock. In addition, the locking position of the pawl may partially or completely comprise the second metallic member, wherein the (separate) second metallic member is attached to the pawl. Preferably, the second metallic member is made of high strength alloy steel or hardened steel and has a surface roughness that is as low as possible. The second metallic member has, in particular, a thickness of between 4 mm and 6 mm, and preferably substantially 5 mm.

According to another preferred embodiment of the invention, the second metallic member comprises a triggering surface. The triggering surface may be, for example, an elevated surface of the second metallic member. In any case, the triggering surface is designed such that a force can be transferred via the triggering surface onto the pawl when the catch is in the first orientation and/or the primary orientation such that the pawl is pivoted away from the catch. The actuation of the triggering surface is carried out regularly by further functional elements of the motor vehicle lock, such as, e.g., by so-called release levers.

It is also advantageous that the latch case comprises a support for the pawl. This support is preferably configured such that in the primary orientation, the support transfers force onto the pawl in the direction of the axis of rotation of the pawl, such that the axis of rotation of the pawl is substantially load-free during operation of the lock. The pawl axis of rotation provides during the lock operation essentially (only) a guiding function for the pawl. Forces acting on the pawl are diverted via the support on the latch case (e.g., in the manner of an abutment). The part of the latch case that forms the support may be provided with a spring element and/or a frictional layer.

Particularly advantageous is a motor vehicle, comprising at least one vehicle door with a motor vehicle lock with an apparatus of the invention.

Although the invention is described herein always in the context of the entire locking mechanism, individual features may be applied (where appropriate in combination with one another) to individual components of the locking mechanism (the catch and/or the pawl) and, as such, are separate inventions.

The invention and the technical background are explained in more detail hereinbelow with reference to the figures. It should be noted that embodiments illustrated in the figures do not limit the invention.

DETAILED DESCRIPTION OF THE INVENTION

Figure 1:
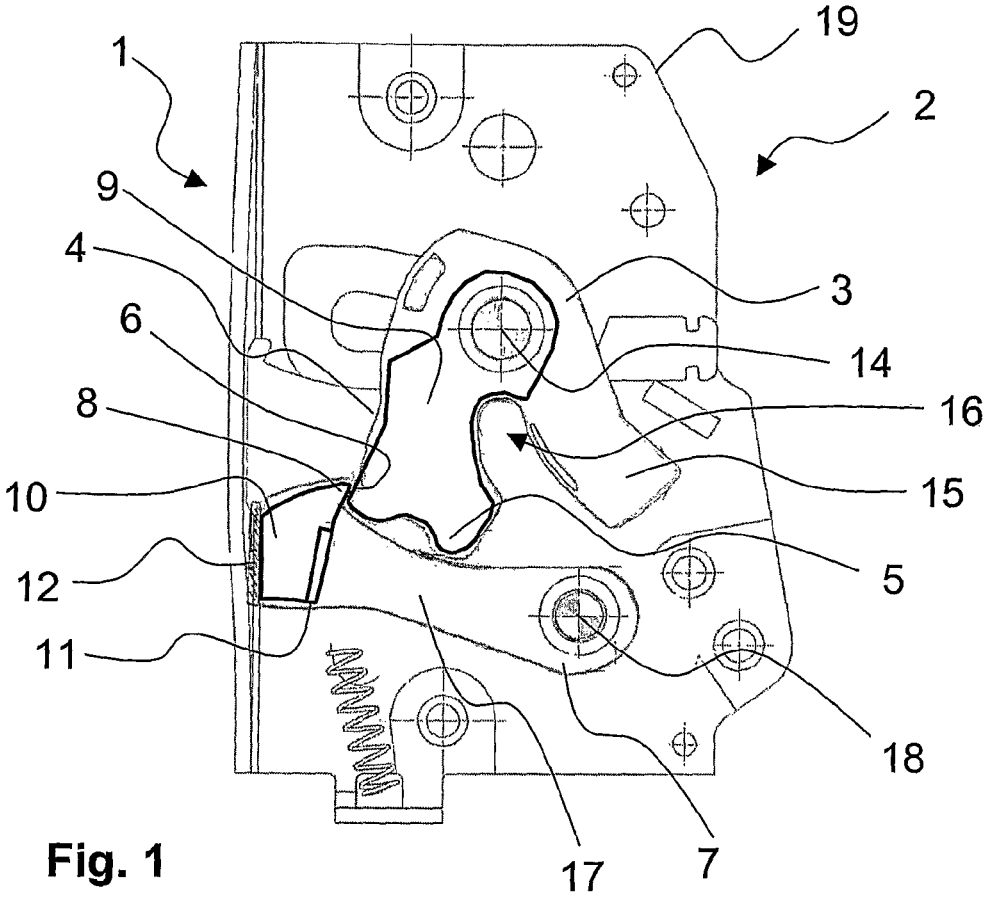
FIG. 1: an apparatus for a motor vehicle.

FIG. 1 shows an apparatus 1 for a motor vehicle lock 2, comprising a latch case 19, a catch 3, and a pawl 7. The catch 3 forms a catch bolt recess 16, which is formed between an impact arm 15 and a work arm 4, and which serves to fix the catch bolt attached to a vehicle body. The work arm forms a first position 5 and a primary position 6 of the catch 3, wherein the work arm 4 extends starting from the first position 5 and the primary position 5, respectively, to the catch rotation axis 14. In this embodiment, a first plate-like metallic member 9 is arranged in the work arm 4.

In addition, FIG. 1 shows a pawl 7 rotatably disposed on the axis of rotation 18. The pawl 7 contacts the primary position 6 of the catch 3 via the locking position 8 of the cantilever arm 17. In the area of the locking position 8 of the pawl is arranged a second metallic member 10, which extends from the locking position 8 of the pawl over the particularly highly used areas of the pawl 7. Furthermore, this second metallic element 10 has a triggering surface 11, via which a force can be transferred onto the pawl 7, which force acts in the direction of the catch 3.

In addition, FIG. 1 shows a support 12 of the latch case 19, which contacts the pawl 7 while the pawl 7 is engaged with the primary position 6 of the catch 3.

Figure 2:
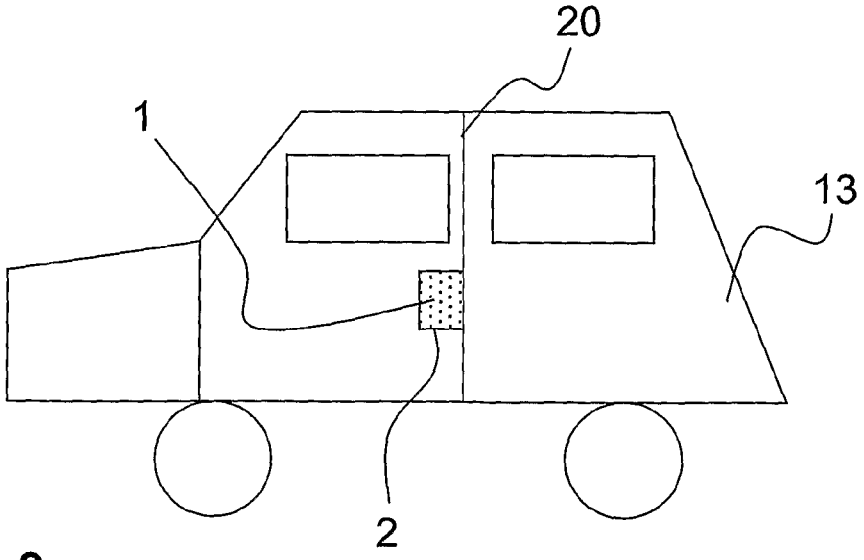
FIG. 2: a motor vehicle with a motor vehicle lock.

FIG. 2 shows a motor vehicle 13 with a motor vehicle door 20 comprising a motor vehicle lock 2 with the inventive apparatus 1.

REFERENCE LIST

1. Apparatus
2. Motor vehicle lock
3. Catch
4. Work arm
5. First position
6. Primary position
7. Pawl
8. Locking position of the pawl
9. First metallic member
10. Second metallic member
11. Triggering surface
12. Support
13. Motor vehicle
14. Axis of rotation of the catch
15. Impact arm
16. Catch bolt recess
17. Cantilever arm
18. Axis of rotation of the pawl
19. Latch case
20. Vehicle door

The invention claimed is:

1. An apparatus for a motor vehicle lock, comprising a catch with a catch axis of rotation, a work arm, an impact arm, and a catch bolt recess, said catch bolt recess being arranged between said work arm and said impact arm, wherein said work arm comprises a first metallic member and has a first catch portion circumferentially spaced from a primary catch portion of the work arm;

a latch case to which the catch is mounted for rotation about the catch axis of rotation between a closed position for capturing a catch bolt and an open position for releasing the catch bolt; and a pawl mounted to the latch case for rotation about a pawl axis of rotation, the pawl having a cantilever arm extending from the pawl axis of rotation and a locking portion at a distal end of the cantilever arm for engaging the first catch portion so as to block movement of the catch toward its open position at a partially closed position of the catch intermediate the open and closed positions of the catch, and for engaging the primary catch portion so as to block movement of the catch toward its open position at the closed position of the catch;

wherein the first catch portion is adjacent to the catch bolt recess and the primary catch portion is adjacent to an outer surface of the work arm opposite the catch bolt recess.

2. The apparatus for a motor vehicle lock of claim 1, wherein said cantilever arm of said pawl comprises a non-metallic material.

3. The apparatus for a motor vehicle lock of claim 1, wherein said impact arm of said catch consists essentially of a non-metallic material.

4. The apparatus for a motor vehicle lock of claim 1, wherein said locking portion comprises a second metallic member.

5. The apparatus for a motor vehicle lock of claim 4, wherein said second metallic member of said locking portion of said pawl comprises a triggering surface.

6. The apparatus for a motor vehicle lock of claim 1, wherein said latch case comprises a support for said pawl that contacts the distal end of the cantilever arm when the pawl is engaged with the primary catch portion.

7. A motor vehicle comprising at least a motor vehicle door with a motor vehicle lock with the apparatus of claim 1.

8. The apparatus for a motor vehicle lock of claim 2, wherein said impact arm of said catch consists essentially of a non-metallic material.

9. previously presented) The apparatus for a motor vehicle lock of claim 2, wherein said locking portion comprises a second metallic member.

10. The apparatus for a motor vehicle lock of claim 3, wherein said locking portion comprises a second metallic member.

11. The apparatus for a motor vehicle lock of claim 8, wherein said locking portion comprises a second metallic member.

12. The apparatus for a motor vehicle lock of claim 2, wherein said latch case comprises a support for said pawl that contacts the distal end of the cantilever arm when the pawl is engaged with the primary catch portion.

13. The apparatus for a motor vehicle lock of claim 3, wherein said latch case comprises a support for said pawl that contacts the distal end of the cantilever arm when the pawl is engaged with the primary catch portion.

14. The apparatus for a motor vehicle lock of claim 4, wherein said latch case comprises a support for said pawl that contacts the distal end of the cantilever arm when the pawl is engaged with the primary catch portion.

15. The apparatus for a motor vehicle lock of claim 5, wherein said latch case comprises a support for said pawl that contacts the distal end of the cantilever arm when the pawl is engaged with the primary catch portion.

16. The apparatus for a motor vehicle lock of claim 8, wherein said latch case comprises a support for said pawl that contacts the distal end of the cantilever arm when the pawl is engaged with the primary catch portion.

17. The apparatus for a motor vehicle lock of claim 9, wherein said latch case comprises a support for said pawl that contacts the distal end of the cantilever arm when the pawl is engaged with the primary catch portion.

18. The apparatus for a motor vehicle lock of claim 10, wherein said latch case comprises a support for said pawl that contacts the distal end of the cantilever arm when the pawl is engaged with the primary catch portion.

19. The apparatus for a motor vehicle lock of claim 11, wherein said latch case comprises a support for said pawl that contacts the distal end of the cantilever arm when the pawl is engaged with the primary catch portion.

20. The apparatus for a motor vehicle lock of claim 1, wherein said cantilever arm of said pawl comprises a non-metallic material; wherein said impact arm of said catch consists essentially of a non-metallic material; wherein said locking portion comprises a second metallic member; wherein said second metallic member of said locking portion of said pawl comprises a triggering surface; and wherein said latch case comprises a support for said pawl.

* * * * *